US005494710A

United States Patent [19]

Mallory, Jr.

[11] Patent Number: 5,494,710

[45] Date of Patent: Feb. 27, 1996

[54] ELECTROLESS NICKEL BATHS FOR ENHANCING HARDNESS

[76] Inventor: Glenn O. Mallory, Jr., c/o Electroless Technologies Corporation 3860 Cloverdale, Los Angeles, Calif. 90008

[21] Appl. No.: 270,907

[22] Filed: Jul. 5, 1994

[51] Int. Cl.[6] ..... B05D 3/04; B05D 1/18

[52] U.S. Cl. ..... 427/438; 427/443.1; 106/1.27

[58] Field of Search ..... 427/438, 443.1; 106/1.27; 428/678, 679, 681

[56] References Cited

U.S. PATENT DOCUMENTS

| | | | |
|---|---|---|---|
| 3,432,338 | 3/1969 | Sickles | 106/1.27 |
| 3,667,972 | 6/1972 | Coll-Palagos | 106/1.27 |
| 3,726,771 | 4/1973 | Coll-Palogos | 106/1.27 |
| 5,213,907 | 5/1993 | Caballero | 428/678 |
| 5,252,360 | 10/1993 | Huttl | 427/438 |
| 5,258,061 | 11/1993 | Martyak | 106/1.27 |

*Primary Examiner*—Marianne Padgett

[57] ABSTRACT

Electroless nickel baths for producing high hardness nickel alloys "as-deposited" containing phosphorus which are produced using baths employing hypophosphite reducing agents at a particular pH range advantageously above 6 and in the presence of a fluoborate anion. The nickel phosphorus alloys "as-deposited" do not require age or heat treatments to produce high hardness with Vickers Harness Number values above about 700 and generally above about 800 to 900 ($VHN_{100}$) and have phosphorus contents below about 4 weight percent and a crystalline nature with crystallite diameters in excess of 60 Angstroms.

7 Claims, No Drawings

ELECTROLESS NICKEL BATHS FOR ENHANCING HARDNESS

This invention relates to electroless nickel baths for producing nickel deposits having improved hardness. More particularly this invention relates to baths for producing hardness enhanced electroless nickel deposits where the baths utilize hypophosphite reducing agents and include a fluoborate hardening agent. Such baths of this invention moreover produce electroless nickel deposits "as-plated" which do not require post plating, hardening enhancing procedures such as conventional heat treating or aging to achieve high hardness.

Electroless nickel plating is a unique and a widely utilized plating process which provides a continuous deposit of a nickel metal coating on metallic or non metallic substrates without the need for an external electric plating current. Such process is described generally as a controlled autocatalytic chemical reduction process for depositing the desired nickel metal and is simply achieved by immersion of the desired substrate into an aqueous plating bath solution under appropriate electroless plating conditions.

The nickel deposit produced by electroless nickel plating is widely utilized as an engineering coating due to its desirable combination of corrosion and wear resistant properties. Unlike electroplated nickel, and particularly when using a hypophosphite reducing agent in the electroless nickel bath, it typically exists as an alloy of nickel and phosphorus. As deposited or plated, electroless nickel generally is not hard enough for many applications. When high hardness values, for example above Vickers Hardness Numbers ($VHN_{100}$) in excess of from above about 700, are required the deposit as produced in the electroless nickel plating must be subjected to post plating hardness improvement. Conventionally such hardness improvement is achieved by heating and or aging the deposit to improve its hardness. Such procedures are, however, both complex and time consuming and often are deleterious to certain substrates upon which the electroless nickel is deposited. For example, hard, electroless nickel coated, tempered aluminum alloys are highly desirable for many commercial applications. However, the aluminum alloys coated with the electroless nickel cannot be subjected to the heat treating annealing temperatures in excess of 150° C. required to harden the nickel because at such temperatures the aluminum alloy losses its temper.

It has now been discovered, however, that hardness, enhanced electroless nickel deposits may be directly achieved "as-plated" without requiring the utilization of conventional post plating, hardness improving procedures. This result is readily accomplished according to this invention through use of an electroless nickel bath containing a fluoborate anion within the bath. This discovery allows a ready and easy procedure for producing hardness enhanced electroless nickel deposits "as-plated" while utilizing conventional baths with typical procedures and techniques for conducting electroless nickel plating. Moreover, the deposits produced from the baths in addition to the unique property of high hardness "as-deposited" with Vickers values above about 800 $VHN_{100}$ also have a low phosphorus content and significantly a crystalline nature. These properties make the deposits uniquely suitable as engineering coatings for such substrates as aluminum and do not require heat or age treatments for hardness improvement.

A fluoborate has previously been utilized in electroless nickel preparation. For example U.S. Pat. No. 3,490,924 employs nickel fluoborate as the source of the nickel ions and the buffer for controlling bath pH. This is not for the hardness improvement of electroless nickel as-plated according to procedures of the present invention. The conventional methods for hardening electroless nickel deposits, such as heat or age treating, have therefore remained the principle and conventional method of hardening notwithstanding the deleterious disadvantages of such methods.

Accordingly an object of this invention is to provide an aqueous bath for producing electroless nickel deposits having improved hardness . Another object is to provide a hardness enhanced nickel deposit prepared with such bath. Still another object is to provide a method for enhancing the hardness of an electroless nickel deposit "as-plated" using such bath. A further object is to provide a hardness improved nickel deposit "as-plated" having unique and novel characteristics. These and other objects of this invention will be apparent from the following further detailed description thereof.

The bath of this invention for preparing hardness enhanced electroless nickel deposits uses a hypophosphite reducing agent and operates under electroless nickel conditions and in its simplest embodiment employs a fluoborate within the bath during the electroless nickel reaction to form the hardness enhanced nickel deposit. The fluoborate used according to this invention is present in the bath as a fluoborate anion and generally any source of a fluoborate anion, $BF_4^-$ may be employed which will produce in solution the fluoborate anion in the aqueous electroless nickel bath. The fluoborate source should not interact or interfere with the electroless nickel plating reaction and appropriate water soluble salts or acids such as alkali metal fluoborates or fluoboric acid may be employed. Water soluble salts are generally preferred such as ammonium and sodium fluoborates which in solution will generate the appropriate fluoborate anion. Another suitable and preferred source is nickel fluoborate which aside from its desirable solubility also adds further nickel cations to the bath solution to favor the reaction kinetics. The fluoborate anion source such as nickel fluoborate is added to the bath with the other components and generally may be present in the bath solution within the range of from about 0.01 to about 0.6 mols per liter and in preferred ranges to maximize the hardness enhancement of the electroless nickel deposit within the range of from about 0,015 to about 0.5 mols per liter or from about 0.015 to 0.04 mols per liter.

The electroless nickel plating baths according to this invention generally employ the conventional methods and techniques used in preparing and operating electroless nickel baths and use electroless nickel conditions of temperature and pH for the electroless nickel reaction. In typical procedures an aqueous bath solution is prepared and charged to an appropriate electroless plating vessel. Such aqueous bath solution is usually prepared by adding to water the desired bath components including the source of the fluoborate anion such as sodium fluoborate, a hypophosphite reducing agent and a source of nickel cations for plating for example a nickel salt such as nickel sulfate. The pH and temperature of the bath are adjusted to the desired ranges followed by immersion of a suitable substrate, appropriately pre-cleaned and treated, within the bath so prepared upon which the nickel is to be plated or deposited.

The substrate employed for such purpose may be a metal such as aluminum, copper or ferrous alloys or a non-metal such as a plastic which may according to established practice be first surface activated. As indicated, however, one of the unique advantages of the bath of this invention is that it produces a hard deposit as plated, that is, it does not require further hardening enhancing such as by high temperature annealing to increase the hardness. This is particularly advantageous for substrates such as aluminum, plastics or printed circuit coatings that cannot be subjected to the high temperatures required for heat annealing electroless nickel without deleterious results.

The pH of the bath is adjusted within the normal ranges employed for operating conventional electroless nickel baths and generally within the acid to alkaline range of from about 4 to about 11. While the bath may employ such ranges the preferred baths for hardness enhancement according to this invention are usually slightly acidic to alkaline and within a pH range of from about 6 to about 8.5 and preferably for a preferred embodiment within the scope of this invention within the neutral to alkaline range of from about 6.5 to about 7.5. High pH ranges are generally less desirable and the advantageous hardness begins to lessen at a pH above about 8.0. The pH is controlled in typical procedures by adding a hydroxide to maintain the desired pH range and conventional hydroxides such as sodium, potassium or ammonium hydroxides may be suitably employed for such purposes.

The hypophosphite reducing agent employed in the baths according to this invention may be any of those conventionally used for electroless nickel plating such as sodium hypophosphite. The amount of the reducing agent employed in the plating bath is at least sufficient to stoichiometrically reduce the nickel cation in the electroless nickel reaction to free nickel metal and such concentration is usually within the range of from about 0.05 to about 1.0 mols per liter. As in conventional practice the reducing agent may be replenished during the reaction.

The source of the nickel cations for the plating may include any of the water soluble or semi-soluble salts of nickel which are conventionally employed. Of these salts nickel chloride, nickel sulfate or preferably nickel sulfamate may be used. Usually the source of nickel is present to sufficiently provide a concentration of nickel cation at from about 0.02 to about 0.3 mols per liter.

The baths according to this invention may contain in addition to the sources of nickel and hypophosphite other conventional bath additives such as buffering, complexing, chelating agents or exaltants as well as stabilizers and brighteners.

The temperature employed for the plating bath is in part a function of the desired rate of plating as well as the composition of the bath. Typically the temperature is within the conventional ranges of from about 25° C. to atmospheric boiling at 100° C., although more preferably below 90° C. and typically within the range of from about 30° to 90° C.

The duration of the plating will be dependent upon the desired thickness of the deposit for a given substrate which in turn will be dependent upon the rate of deposition which usually is a function of bath temperature and the particular selection and concentration of bath constituents. Usually, however, the rate of deposition and consequently the duration of the plating within the baths of this invention are similar to those employed conventionally in electroless nickel plating baths and consequently the length of any particular plating will parallel those used for a similar conventional electroless nickel bath.

The electroless nickel deposits produced according to bath of this invention are novel and possess a particular combination of unique and desirable properties. Like other electroless nickel deposits they are generally characterized as alloys of nickel and phosphorus . However, distinct from conventional electroless nickels, the nickel phosphorus alloys of this invention contain generally less than or below about 5 to 7 and more typically less than about 4 weight percent phosphorus in contrast with conventional nickel phosphorus electroless alloys which usually contain a range of from above about 7 to 10 weight percent phosphorus. Further unlike conventional electroless nickels which x-ray diffraction shows to usually be amorphous or non-crystalline as deposited the electroless nickels of this invention are micro crystalline in nature and have nickel phosphide crystallite diameters in excess of about 60 Angstroms. Most uniquely, however, and as described herein the electroless nickel deposits of this invention possess a high hardness as deposited, that is as plated without heating or age treating at annealing temperatures to achieve high hardness required for many commercial applications. Such hardness exceeds that normally found in electroless nickel as plated which in terms of Vickers Hardness ($VHN_{100}$) typically ranges from about 500 to 650 $VHN_{100}$ in contrast to those of the present invention which as plated is above about 650 and typically above about 800 $VHN_{100}$. As referenced herein and in the Examples hardness is usually characterized as the resistance of a material, in this case electroless nickel, to plastic flow and for thin electroless nickel deposits is conventionally determined using micro hardness testing techniques referenced in the ASTM Test Method 578 "Standard Test Method of Microhardness of Electroplated Coatings". Results are expressed as $VHN_{100}$ numbers with higher values indicating higher hardness recognizing the testing and loading employed in the test methodology.

The following Examples are offered to illustrate the improved electroless nickel plating baths of this invention and the modes of carrying out such invention:

A series of electroless nickel plating baths were prepared in accordance with conventional procedures using stock solutions prepared for the bath components and utilizing deionized, carbon treated and filtered water and plating grade chemicals. The concentrations of bath components were analyzed by standard, spectrographic, emission and absorption techniques.

The baths were formulated as follows:

| Constituent | Concentration, Mols/Liter (M) |
|---|---|
| Example I | |
| Lactic Acid | 0.26 |
| Acetic Acid | 0.25 |
| Sodium Acetate | 0.25 |
| Sodium Hypophosphite | 0.20 |
| Nickel Sulfate | 0.085 |
| Ammonium Fluoborate $NH_4BF_4$ | 0.035 |
| Example II | |
| Propionic Acid | 0.30 |
| Glycine | 0.25 |
| Sodium Hypophosphite | 0.25 |
| Nickel Sulfate | 0.07 |
| Nickel Fluoborate $Ni(BF_4)_2$ | 0.0175 |
| Example III | |
| Citric Acid | 0.13 |
| Acetic Acid | 0.40 |
| Sodium Hypophosphite | 0.22 |
| Nickel Sulfate | 0.085 |
| Sodium Fluoborate | 0.04 |
| Example IV | |
| Propionic Acid | 0.30 |
| Glycine | 0.25 |
| Sodium Hypophosphite | 0.25 |
| Nickel Sulfate | 0.085 |

-continued

| Constituent | Concentration, Mols/Liter (M) |
|---|---|
| Example V | |
| Acetic Acid | 0.35 |
| Lactic Acid | 0.25 |
| Sodium Hypophosphite | 0.25 |
| Nickel Sulfamate | 0.07 |
| Nickel Fluoborate | 0.018 |

The conditions of the baths were as follows

TABLE I

| Bath Conditions | | | |
|---|---|---|---|
| Example | pH | Temperature, °C. | Hydroxide |
| I | 6.5 | 87 | Ammonium Hydroxide |
| II | 7.0 | 87 | Sodium Hydroxide |
| III | 7.5 | 88 | Potassium Hydroxide |
| IV | 6.5 | 87 | Ammonium Hydroxide |
| V | 7.0 | 87 | Ammonium Hydroxide |

The baths were operated as follows:

Steel panels, cleaned and degreased, were plated in four liter baths containing the constituents shown for the above Examples and at the temperatures shown in the above Table I. The baths were analyzed for nickel and hypophosphite content and such constituents were replenished as required according to normal practice during operation of the baths. The pH of the baths was maintained at the value shown in the above Table I by adding a 2.5 molar(M) solution of the indicated hydroxide for each Example. After a period appropriate to build up a deposit thickness of about 3 mils, the plating was discontinued and the electroless nickel deposits on the steel panels/coupons were analyzed for phosphorus content and tested for Vickers hardness according to ASTM Test Method No B 578 The results are summarized in the following Table II

TABLE II

| Example | Hardness Vickers, $VH_{N100}$ | Phosphorus Wt. % |
|---|---|---|
| I | 825 | 3.8 |
| II | 882 | 3.92 |
| III | 870 | 3.76 |
| IV | 635 | 3.8 |
| V | 882 | 3.4 |

As shown from the data summarized in Table II the hardness of the deposit for Example IV which was prepared from a bath without a fluoborate anion was less than the hardness of the deposits prepared within the baths of the other Examples which contained a fluoborate anion.

I claim:

1. A method for producing an electroless plated nickel deposit, the improvement comprising conducting electroless nickel plating of the deposit within a bath to produce said deposit having a hardness as-plated above about 800 $VHN_{100}$, said bath being an aqueous electroless plating bath comprising a first compound as a source of nickel cations, a hypophosphite reducing agent, and a second compound as a source of a fluoborate anion and with said bath being operated under electroless nickel plating conditions and maintained at a pH range of from about 6 to about 8.5.

2. The method of claim 1 wherein the source of nickel cations is nickel sulfamate.

3. The method of claim 1 wherein the source of the fluoborate anion is nickel fluoborate.

4. The method of claim 1 wherein the source of the fluoborate anion is present is the bath within the range of from about 0.01 to about 0.6 mols per liter.

5. The method of claim 1 wherein the bath is maintained at a pH within the range of from about 7.5.

6. The method of claim 5 wherein the fluoborate anion is nickel fluoborate and source of the nickel cations is nickel sulfamate.

7. The method of claim 1 wherein the hardness of the deposit is above about 800 $VHN_{100}$ and the deposit contains less than about 4 weight percent phosphorus.

* * * * *